US007414457B2

(12) United States Patent
Ogawa et al.

(10) Patent No.: US 7,414,457 B2
(45) Date of Patent: Aug. 19, 2008

(54) BIAS VOLTAGE GENERATING CIRCUIT

(75) Inventors: Munehiko Ogawa, Osaka (JP); Kazuyoshi Nishi, Kyoto (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 51 days.

(21) Appl. No.: 11/595,898

(22) Filed: Nov. 13, 2006

(65) Prior Publication Data

US 2007/0109038 A1 May 17, 2007

(30) Foreign Application Priority Data

Nov. 17, 2005 (JP) ..... 2005-332379

(51) Int. Cl.
*G05F 1/10* (2006.01)

(52) U.S. Cl. ..... 327/538; 327/540; 327/544

(58) Field of Classification Search ..... 327/538, 327/540, 544

See application file for complete search history.

(56) References Cited

U.S. PATENT DOCUMENTS

| | | | | |
|---|---|---|---|---|
| 6,163,206 | A | 12/2000 | Kobayashi | |
| 6,930,543 | B2 | 8/2005 | Nishi | |
| 6,982,706 | B1 * | 1/2006 | Doi et al. | 345/206 |
| 2002/0121883 | A1 | 9/2002 | Bartenschlager et al. | |
| 2004/0104762 | A1 | 6/2004 | Nishi | |
| 2004/0212421 | A1 | 10/2004 | Naka et al. | |

* cited by examiner

*Primary Examiner*—Kenneth B. Wells
(74) *Attorney, Agent, or Firm*—McDermott Will & Emery LLP

(57) ABSTRACT

In a bias voltage generating circuit for outputting through switching over a plurality of bias voltages and standby voltages provided for the respective bias voltages, a voltage return unit is provided for each bias voltage, and charges stored in the voltage return unit are supplied before power ON starts so that the bias voltage is approximated to a predetermined voltage. A drive controller drives the voltage return unit and a standby voltage generator, and a period of driving control is arbitrarily set by a register.

9 Claims, 12 Drawing Sheets

BIAS VOLTAGE GENERATING CIRCUIT

BACKGROUND OF THE INVENTION

1. Field of the Invention

The present invention relates to a bias voltage generating circuit for generating a bias voltage of a drive circuit for activating a liquid crystal panel or the like, more specifically to a bias voltage generating circuit capable of turning off in a power-saving state and returning from the power-saving state to an operation state at a high speed.

2. Description of the Related Art

In recent years, a liquid crystal panel has been applied to various devices in a broader range including large-size devices and small-size devices such as a mobile telephone, there has been an increasing demand for reduction of power consumption in response to circumstances. An effective method in order to reduce the power consumption is that a liquid crystal drive circuit leaves an output circuit in a halting state during a blanking period, which is a non-display period, so that a steady-state current is zeroed (hereinafter, referred to as power saving processing). Another preferable method for reducing the power consumption is to increase in frequency of the power saving processing. In order to increase in frequency of the power saving processing, it is important to speed up a returning process from a power-saving state to an operation state.

Below, a bias voltage generating circuit and a drive output circuit are described according to a conventional technology, an example of which is recited in U.S. Pat. No. 6,930,543, referring to FIG. 1. FIG. 1 is a circuit diagram illustrating a bias voltage generating circuit of an operational amplifier for driving the liquid crystal and a drive output circuit whose output number is n according to the conventional technology. The description is given below based on an example in which the drive output number is n.

A reference numeral 100 shown in FIG. 1 denotes a bias voltage generating circuit. The bias voltage generating circuit 100 comprises a reference voltage generator 20 and a standby voltage generator 30. The reference voltage generator 20 comprises P-channel MOS transistors MP1, MP2 and MP3, N-channel MOS transistors MN1 and MN2, and a resistance R1. The standby voltage generator 30 comprises a switch SW1 connected between a ground voltage and a bias voltage Vbiasn. The bias voltage generating circuit 100 thus constituted has a function of outputting the bias voltage Vbiasn of NMOS transistors for a constant current source in operational amplifiers A1(1)-A1(*n*) for driving the liquid crystal. In the drawing, C1*n*(1)-C1*n*(n) denotes a wiring capacitance respectively.

An operation of returning the bias voltage generating circuit 100 from a power-off state is described referring to a timing chart shown in FIG. 2. A power save signal PS is set to a non-active state "high" in a T1 period where a main power is in ON state. Therefore, the P-channel MOS transistor MP3 of the reference voltage generator 20 is turned off, while the N-channel MOS transistor MN1 thereof is turned on.

At the time, the P-channel MOS transistor MP1, resistance R1 and N-channel MOS transistor MN1 of the reference voltage generator 20 generate a reference current Iref1. A current mirror circuit comprising the P-channel MOS transistors MP1 and MP2 generates a reference current Iref2. The N-channel MOS transistor MN2 diode-connected to the P-channel MOS transistor MP2 generates the bias voltage Vbiasn based on the reference current Iref2. The bias voltage Vbiasn is supplied to input capacitances of the operational amplifiers A1(1)-A1(*n*) for driving the liquid crystal and wiring capacitances C1*n*(1)-C1*n*(n). The T1 period is a period when output control switches SW10(1)-SW10(*n*) of outputs Vout(1)-Vout(n) of the operational amplifiers for driving the liquid crystal are set to ON.

The output control switches SW10(1)-SW10(*n*) are turned off in a T2 period where a first sub power is in ON state, while any other control operation is the same as that of the T1 period. When the output control switches SW10(1)-SW10(*n*) are turned off and simultaneously the power save signal is set to an active state "Low", the output voltages of the operational amplifiers A1(1)-A1(*n*) for driving the liquid crystal are thereby influenced. Therefore, the T2 period (first sub power ON state) is provided as an overlapping period (non-active state "high").

In a T3 period that is a power OFF state, as the power save signal PS is set to the active state "Low", the P-channel MOS transistor MP3 of the reference voltage generator 20 is turned on, while the N-channel MOS transistor MN1 is turned off. In other words, the reference current Iref1 is "0" so as to be the power OFF state. At the time, as the switch SW1 for controlling the standby voltage output is set to ON, the bias voltage Vbiasn is thereby "low".

In a T4 period that is a second sub power ON state, the switch SW1 for controlling the standby voltage output is turned off, and the output control switches SW10(1)-SW10(*n*) are also set to OFF. During the period, the bias voltage Vbiasn returns to a predetermined voltage, and the restoring operation is then completed.

In a T5 period that is the main power ON state, the switch SW1 for controlling the standby voltage output is turned off, while the output control switches SW10(1)-SW10(*n*) are turned on. Thereby, the operational amplifiers A1(1)-A1(*n*) for driving the liquid crystal output the Vout(1)-Vout(n) at a predetermined voltage level.

In the conventional bias voltage generating circuit, the small reference current Iref2 generated by the P-channel MOS transistor MP2 and the N-channel MOS transistor MN3 is used to charge the input capacitances of the operational amplifiers A1(1)-A1(*n*) for driving the liquid crystal and the wiring capacitances C1*n*(1)-C1*n*(n), so that the bias voltage returns to the predetermined voltage.

In recent years, the number of the operational amplifiers A1(1)-A1(*n*) for driving the liquid crystal is increased based on a large-screen and a higher image quality of the liquid crystal panel. More specifically, the input capacitances of the operational amplifiers A1(1)-A1(*n*) for driving the liquid crystal and n of the wiring capacitances C1*n*(1)-C1*n*(n) are increased, which makes it necessary to supply a large capacitance value with a small current. As a result, it becomes impossible for the bias voltage to return within a predetermined time frame.

Though it is possible to make bias voltage return within the predetermined time frame by increasing the reference current Iref2 of the bias voltage generating circuit, however, it results in the large increase of the power consumption.

SUMMARY OF THE INVENTION

Therefore, a main object of the present invention is to provide a bias voltage generating circuit capable of making the bias voltage return speedily without increasing the reference current Iref2.

In order to achieve the foregoing object, a bias voltage generating circuit for generating a predetermined reference voltage suitable for a power ON state and a standby voltage suitable for a power OFF state as a bias voltage in response to the power ON/OFF switchover according to the present invention comprises:

a reference voltage generator for generating the reference voltage;

a standby voltage generator for generating the standby voltage;

a bias wiring for outputting the bias voltage;

a voltage return unit comprising a charge storing element and a first switch for connecting or disconnecting the charge storing element to the bias wiring; and a drive controller for controlling the standby voltage generator and the voltage return unit, wherein the drive controller switches over the first switch from an OFF state to an ON state before the power ON state is switched to the power OFF state to thereby store the bias voltage in the charge storing element, and turns on the first switch from the OFF state before the power OFF state is switched to the power ON state to thereby discharge the bias voltage stored in the charge storing element to an output load capacitance of the bias voltage generating circuit, and the drive controller further approximates the bias voltage to the predetermined voltage and then starts to shift the bias voltage to the predetermined voltage before the power ON starts.

According to the foregoing constitution, the bias voltage can return at a high speed.

As a preferable mode of the present invention, the bias voltage generating circuit further comprises a register, wherein the drive controller outputs control signal for controlling a charge/discharge period by the voltage return unit and an output period of the standby voltage by the standby voltage generator, and the register arbitrarily fluctuates the control signal to thereby arbitrarily change the charge/discharge period by the voltage return unit and the output period of the standby voltage by the standby voltage generator.

According to the foregoing constitution, the voltage in starting the returning operation can be arbitrarily changed in accordance with the setting of the register, and the bias voltage restoring operation can be started after the bias voltage is set to such an optimum return start voltage that minimizes an amount of time necessary for returning. As a result, the bias voltage can return more speedily.

As another preferable mode of the present invention, the voltage return unit further comprises a second switch for controlling permission or non-permission of the load capacitance output by the bias voltage generating circuit, the drive controller further controls the second switch, and the drive controller switches over the first switch from the OFF state to the ON state and simultaneously turns off the second switch from the ON state before the power ON state is switched to the power OFF state.

According to the foregoing constitution, it becomes unnecessary to charge the output load of the bias voltage generating circuit in the charging operation for the high-speed returning, and a capacitance value of the charge storing element of the voltage return unit can be thereby increased. Thereby, the bias voltage returning operation can be started after the bias voltage is further approximated to the predetermined voltage. As a result, the bias voltage can return more speedily.

As a preferable mode of the foregoing mode, the bias voltage generating circuit further comprises a register, wherein the drive controller outputs control signal for controlling a charge/discharge period by the voltage return unit, a short-circuit period by the second switch, and an output period of the standby voltage by the standby voltage generator, and the register fluctuates the control signal to thereby arbitrarily change the charge/discharge period by the voltage return unit, the short-circuit period by the second switch, and the output period of the standby voltage by the standby voltage generator.

According to the foregoing constitution, the voltage in starting the returning operation can be arbitrarily changed in accordance with the setting of the register. Therefore, the bias voltage returning operation can be started after the bias voltage is set to such an optimum returning start voltage that minimizes the returning time. As a result, the bias voltage can return more speedily.

As yet another preferable mode of the vias voltage generating circuit according to the present invention, the voltage return unit comprises a charging circuit for charging the charge storing element and a charging time controller for controlling a power ON period of the charging circuit, and the drive controller controls the standby voltage generator and the voltage return unit.

According to the foregoing constitution, the charge storing element of the voltage return unit can be constantly charged by the charging circuit during the power ON period, which increases the capacitance value of the charge storing element of the voltage return unit. Therefore, the bias voltage returning operation can be started after the bias voltage is further approximated to the predetermined voltage. As a result, the bias voltage can return more speedily.

As a preferable mode of the foregoing mode, the bias voltage generating circuit further comprises a first register, wherein the charging time controller outputs a control signal for controlling a charge/discharge period by the voltage restorer, and the first register fluctuates the control signal to thereby arbitrarily change the charge/discharge period by the voltage return unit.

According to the foregoing mode, the bias voltage returning operation can be started from a state where the bias voltage is set to such an optimum returning start voltage that minimizes the returning time. As a result, the bias voltage can return more speedily.

As another preferable mode of the foregoing mode, the bias voltage generating circuit further comprises:

a charge voltage selector for fluctuating an output voltage of the charging circuit; and a second register for arbitrarily changing a charge amount stored in the charge storing element by controlling the charge voltage selector.

According to the foregoing mode, the charging voltage for the charge storing element can be arbitrarily changed in accordance with the setting of the second register. Thereby, the bias voltage returning operation can be started from a state where the bias voltage is set to such an optimum return start voltage that minimizes the return time. As a result, the bias voltage can return more speedily.

Another embodiment of the bias voltage generating circuit according to the present invention comprises:

a reference voltage generator for generating a reference voltage;

a standby voltage generator for generating a standby voltage;

a voltage return unit comprising a first switch for short-circuiting the reference voltage and the standby voltage and a second switch for separating the reference voltage generator from an output of the bias voltage generating circuit; and a drive controller for controlling the standby voltage generator and the voltage return unit, wherein the drive controller switches over the first switch from the OFF state to the ON state to thereby short-circuit the reference voltage and the standby voltage under turning off the second switch from the ON state before the power ON state is switched to the power OFF state to thereby separate the reference voltage generating circuit, and the drive controller further approximates the bias voltage to a predetermined voltage and then starts to shift the bias voltage to the predetermined voltage before the power ON starts.

According to the foregoing constitution, the two bias voltage output wirings can be short-circuited. Therefore, the bias voltage returning operation can be started after the bias voltage is approximated to the predetermined voltage. As a result, the bias voltage can return at a high speed.

As a preferable mode of the present invention, the bias voltage generating circuit further comprises a register, wherein the drive controller outputs control signal for controlling a short-circuit period of the first switch and an output period of the standby voltage, and the register arbitrarily fluctuates the control signal to thereby voluntarily change the short-circuit period of the first switch and the output period of the standby voltage by the standby voltage generator.

According to the foregoing mode, the short-circuit period of the switch of the voltage return unit and the output period of the standby voltage can be arbitrarily changed in accordance with the setting of the register. As a result, the bias voltage can return more speedily after the bias voltage is further approximated to such an optimum voltage that minimizes the returning time.

As thus far described, in the present invention, the voltage return unit and the drive controller are further provided in the conventional circuit so that the bias voltage returning operation can be started from a state where the bias voltage is approximated to the predetermined voltage. Such a constitution can exert a large effect in the reduction of the returning time.

The bias voltage generating circuit according to the present invention can be effectively used as a reference voltage source of a device in which a time length required for shifting to the usual operation state through switching the power saving state to the power ON state is desirably reduced because the bias voltage can return at a high speed like this.

BRIEF DESCRIPTION OF THE DRAWINGS

These and other objects as well as advantages of the invention will become clear by the following description of preferred embodiments of the invention. A number of benefits not recited in this specification will come to the attention of the skilled in the art upon the implementation of the present invention.

DETAILED DESCRIPTION OF THE INVENTION

Figure 1:
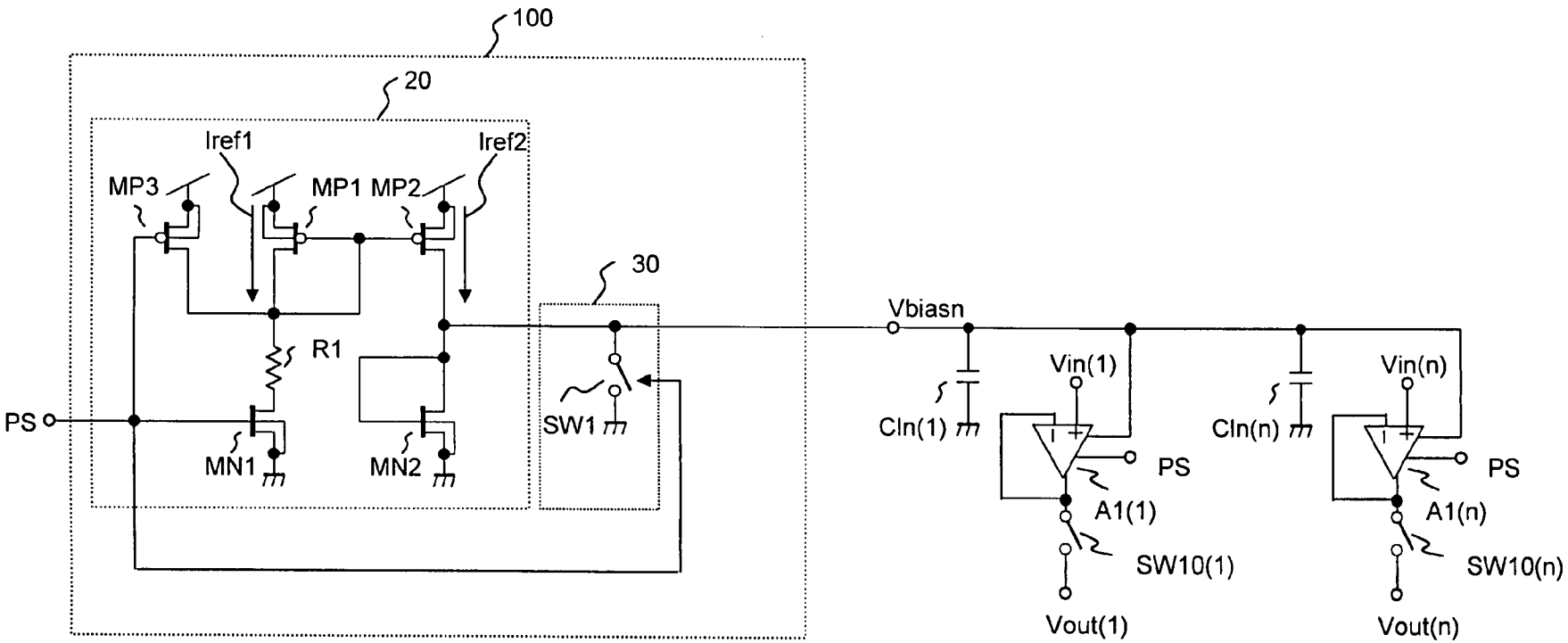
FIG. 1 PRIOR ART
FIG. 1 is a circuit diagram of a bias voltage generating circuit according to a conventional technology.
Figure 2:
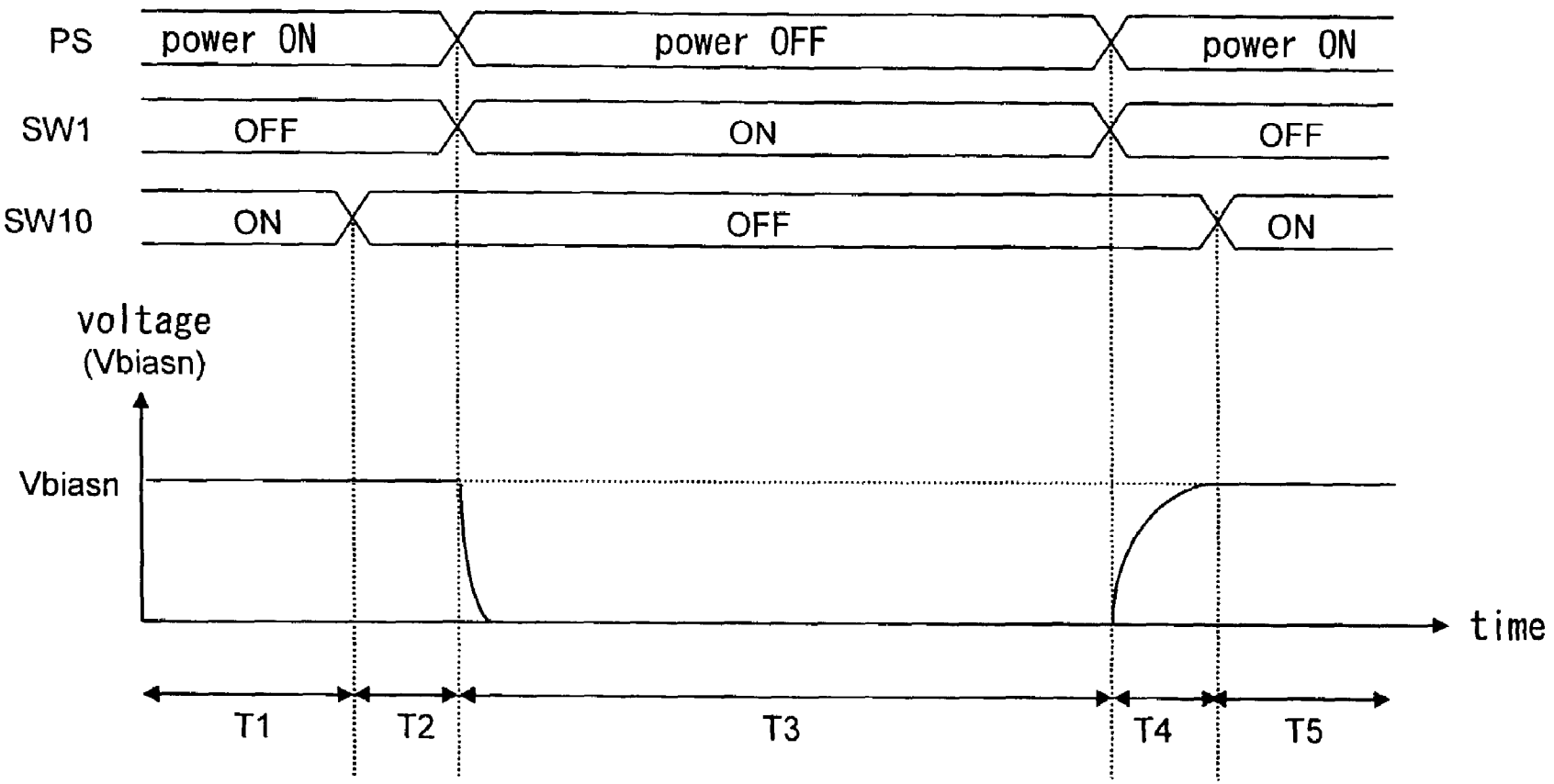
FIG. 2 PRIOR ART
FIG. 2 is a timing chart of the conventional bias voltage generating circuit.

Hereinafter, preferred embodiments of the present invention are described referring to the drawings.

Preferred Embodiment 1

Figure 3:
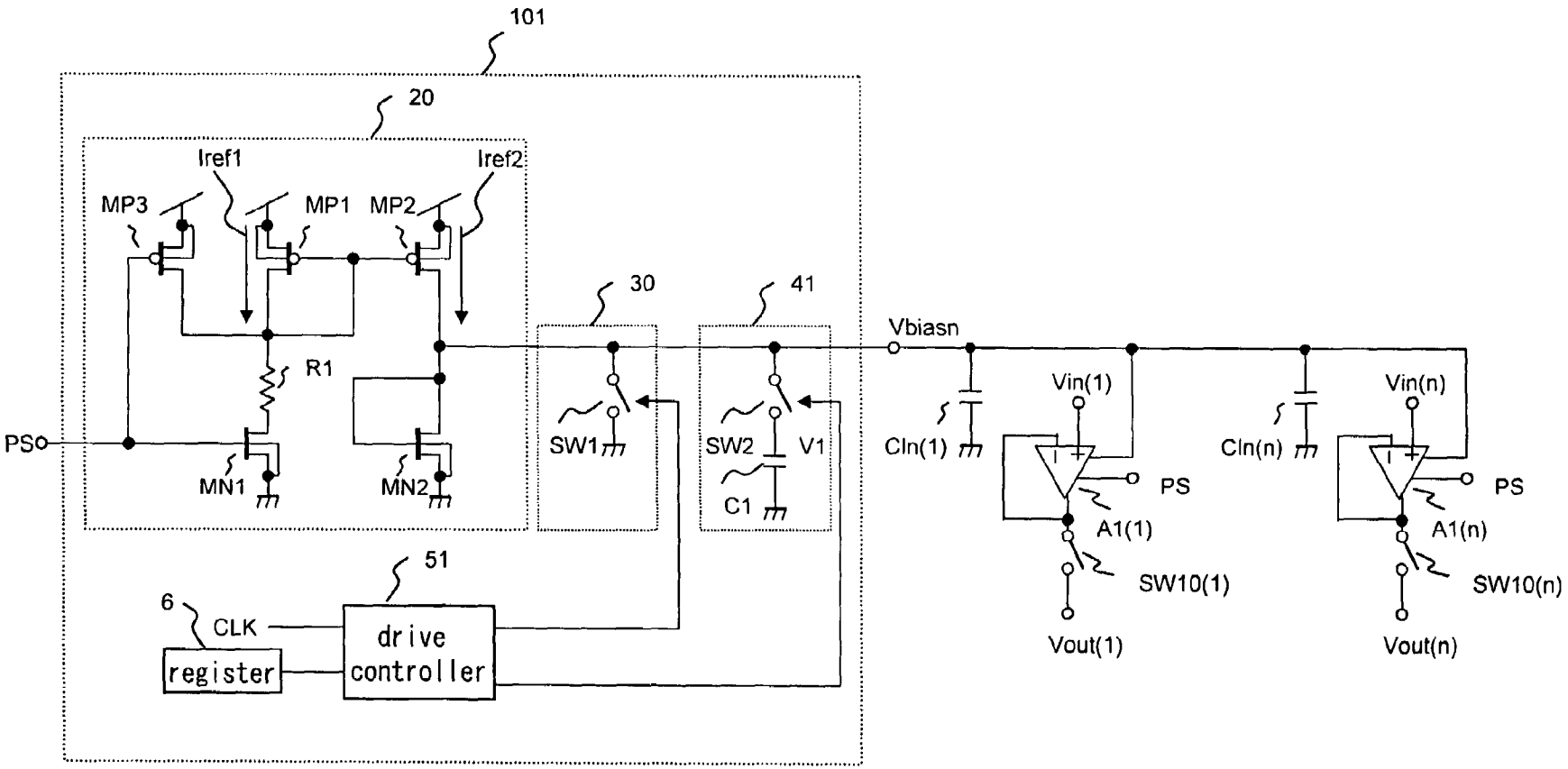
FIG. 3 is a circuit diagram of a bias voltage generating circuit according to a preferred embodiment 1 of the present invention.

FIG. 3 is a circuit diagram of a bias voltage generating circuit according to a preferred embodiment 1 of the present invention. The description of the present invention given below is based on an example of the bias voltage generating circuit for driving liquid crystal in which a drive output number is n.

In FIG. 3, a reference numeral 101 denotes a bias voltage generating circuit. The bias voltage generating circuit 101 comprises a reference voltage generator 20, a standby voltage generator 30, a voltage return unit 41, a drive controller 51, and a register 6.

The reference voltage generator 20 comprises P-channel MOS transistors MP1, MP2 and MP3, N-channel MOS transistors MN1 and MN2, and a resistance R1. The standby voltage generator 30 comprises a switch SW1 connected to a ground voltage and a bias voltage Vbiasn. The voltage return unit 41 comprises a charge storing element C1 and a switch SW2. The drive controller 51 controls the standby voltage generator 30 and the voltage return unit 41. The register 6 controls the drive controller 51.

The bias voltage generating circuit 101 has a function of outputting the bias voltage Vbiasn of NMOS transistors for a constant current source in operational amplifiers A1(1)-A1(*n*) for driving the liquid crystal. In the drawing, C1*n*(1)-C1*n*(n) denotes a wiring capacitance respectively.

The drive controller 51 has first and second functions. The first function is function of controlling a period when the standby voltage is outputted from the standby voltage generator 30 as the output Vbiasn of the bias voltage generating circuit 101 in accordance with a clock input signal CLK and a set value of the register. The second function is a function of controlling a charge/discharge period of the charge storing element C1 in the voltage return unit 41.

Figure 4:
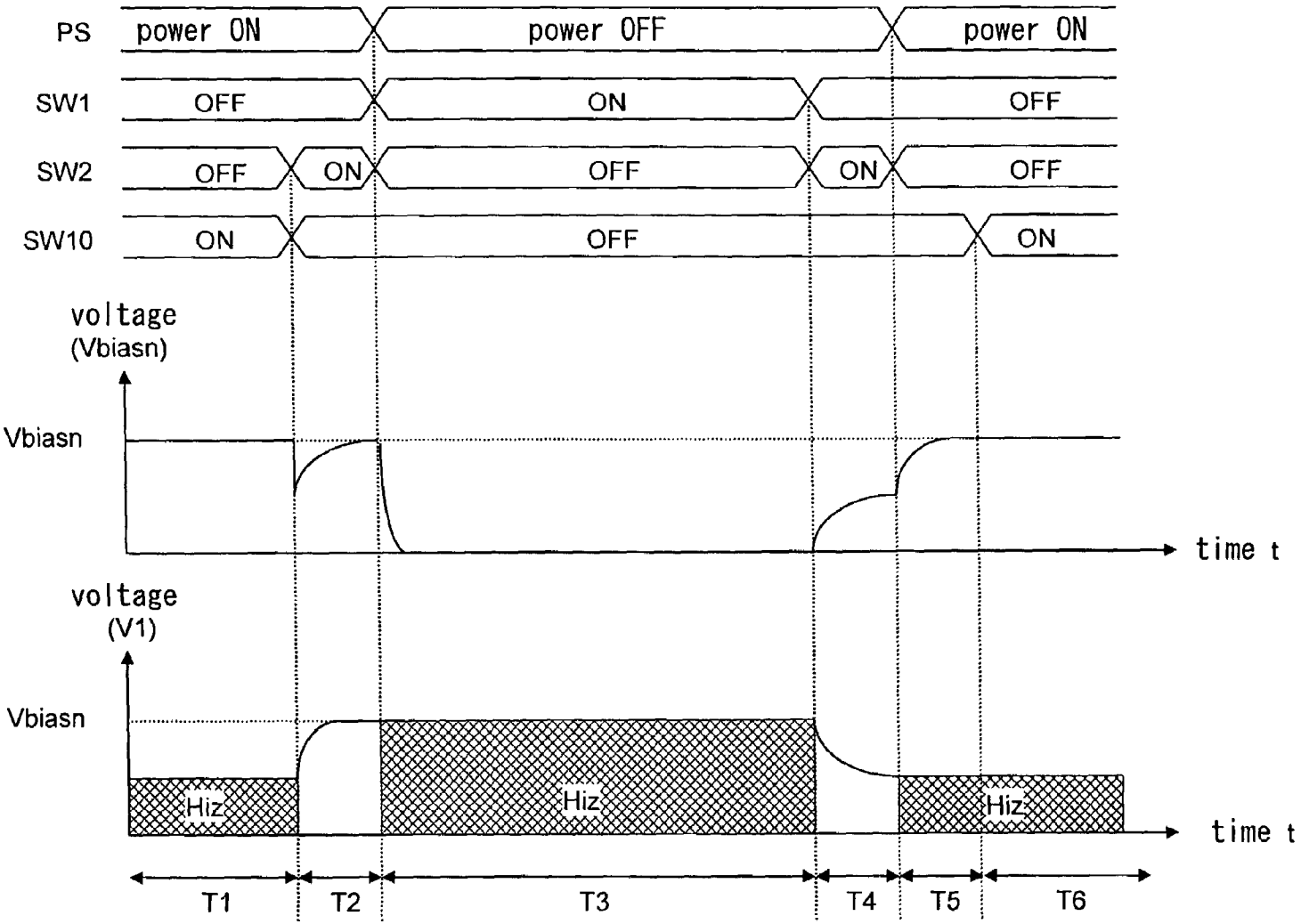
FIG. 4 is a timing chart of the bias voltage generating circuit according to the preferred embodiment 1.

Next, a returning operation of the bias voltage generating circuit 101 thus constituted from a power OFF state is described referring to a timing chart shown in FIG. 4. In a T1 period where a main power is in ON state, the standby voltage output control switch SW1 and the return voltage output control switch SW2 are turned off, and output control switches SW10(1)-SW10(*n*) of outputs Vout(1)-Vout(n) of the operational amplifiers for driving the liquid crystal are turned on.

As a power save signal PS is set to a non-active state "high" in the T1 period, the P-channel MOS transistor MP3 of the reference voltage generator 20 is turned off, while the N-channel MOS transistor MN1 thereof is turned on.

At the time, the P-channel MOS transistor MP1, resistance R1 and N-channel MOS transistor MN1 of the reference voltage generator 20 generate a reference current Iref1. A current mirror circuit comprising the P-channel MOS transistors MP1 and MP2 generates a reference current Iref2. The N-channel MOS transistor MN2 diode-connected to the P-channel MOS transistor MP2 generates the bias voltage Vbiasn based on the reference current Iref2. The bias voltage Vbiasn is supplied to input capacitances of the operational amplifiers A1(1)-A1(*n*) for driving the liquid crystal and wiring capacitances C1*n*(1)-C1*n*(n).

In a T2 period where a first sub power is in ON state, the power save signal PS is maintained in the non-active state "high". The standby voltage output control switch SW1 remains OFF in the same manner as in the T1 period, while the return voltage output control switch SW2 is turned on. The output control switches SW10(1)-SW10(*n*) of the outputs Vout(1)-Vout(n) of the operational amplifiers for driving the liquid crystal are turned off.

In the T2 period, the return voltage control switch SW2 is turned on, and the charge storing element C1 is thereby connected to the bias voltage Vbiasn. As a result, the charge storing element C1 of the voltage return unit 41 is charged. At the time, the voltage of the bias voltage Vbiasn is fluctuated by connecting the charge storing element C1 to the bias voltage Vbiasn. However, the output voltages Vout of the operational amplifiers for driving the liquid crystal are not affected by the fluctuation because the output control switches SW10(1)-SW10(*n*) of the outputs Vout(1)-Vout(n) of the operational amplifiers for driving the liquid crystal are set to OFF.

In a T3 period where a main power is in OFF state, the standby voltage output control switch SW1 is turned on, while the return voltage output control switch SW2 and the output control switches SW10(1)-SW10(*n*) of the outputs Vout(1)-Vout(n) of the operational amplifiers for driving the liquid crystal are turned off.

The power save signal PS is set to the active state "Low" in the T3 period (main power OFF state). Accordingly, the P-channel MOS transistor MP3 and the N-channel MOS transistor MN3 of the reference voltage generator 20 are turned on, while the N-channel MOS transistor MN1 of the reference voltage generator 20 is turned off. Thereby, the reference current Iref1 is set to "0" so as to result in the power OFF state.

The bias voltage Vbiasn is "low" because the standby voltage output control switch SW1 is turned on and the return voltage output control switch SW2 is turned off.

In a T4 period where a sub power is in OFF state, the power save signal PS is maintained in the active state "low". The standby voltage output control switch SW1 is turned off, the return voltage output control switch SW2 is turned on, and The output control switches SW10(1)-SW10(*n*) of outputs Vout(1)-Vout(n) of the operational amplifiers A1(1)-A1(*n*) for driving the liquid crystal are turned off.

In the T4 period, the charges stored in the charge storing element C1 during the T2 period are discharged to the input capacitances of the operational amplifiers A1(1)-A1(*n*) for driving the liquid crystal and the wiring capacitances C1*n*(1)-C1*n*(n), as a result, the voltage of the bias voltage Vbiasn is approximated to a predetermined voltage before the power ON starts.

In a T5 period where a second sub power is in ON state, the power save signal PS is set to the non-active state "high". The standby voltage output control switch SW1, return voltage output control switch SW2, and output control switches SW10(1)-SW10(*n*) of the outputs Vout(1)-Vout(n) of the operational amplifiers for driving the liquid crystal are turned off.

In the T5 period, the voltage approximated to the predetermined voltage in the T4 period is used as a return start voltage of the bias voltage Vbiasn. Therefore, the bias voltage Vbiasn returns to the predetermined voltage by only the reference current Iref2 of the reference voltage generating circuit.

In a T6 period where the main power is in ON state, the power save signal PS is maintained in the non-active state "high". The respective control signals are the same control as in the T1 period. However, the T6 period is a period immediately after the output control switches SW10(1)-SW10(*n*) of outputs Vout(1)-Vout(n) of the operational amplifiers for driving the liquid crystal are switched from OFF to ON, it is necessary to complete the return of the bias voltage Vbiasn to the predetermined voltage.

As described above, the voltage return unit 41 capable of charging/discharging the return voltage and the drive controller 51 are provided in the bias voltage generating circuit 101 according to the preferred embodiment 1. Therefore, after the bias voltage Vbiasn in the power OFF state is approximated once to the predetermined voltage at initiating power ON, the operation for returning start of the power ON state from that state can be initiated. Such an operation was not possible in the conventional bias voltage generating circuit in which only the current from the reference voltage generator 20 was used for the return operation. As a result of the foregoing improvement, the bias voltage Vbiasn of the operational amplifiers for driving liquid crystal can return at a high speed in the bias voltage generating circuit 101 according to the preferred embodiment 1.

Further, the register 6 capable of controlling the ON and OFF periods of the standby voltage output control switch SW1 and the ON and OFF periods of the return voltage output control switch SW2 is provided so that the bias voltage Vbiasn at initiation of the power ON can be adjusted depending on only change of the register 6. As a result, the bias voltage Vbiasn can return at a high speed even in the case where an amount of time required for the returning is delayed since circuit characteristics are deteriorated due to variations generated in a temperature, a power-supply voltage and the like.

Preferred Embodiment 2

Figure 5:
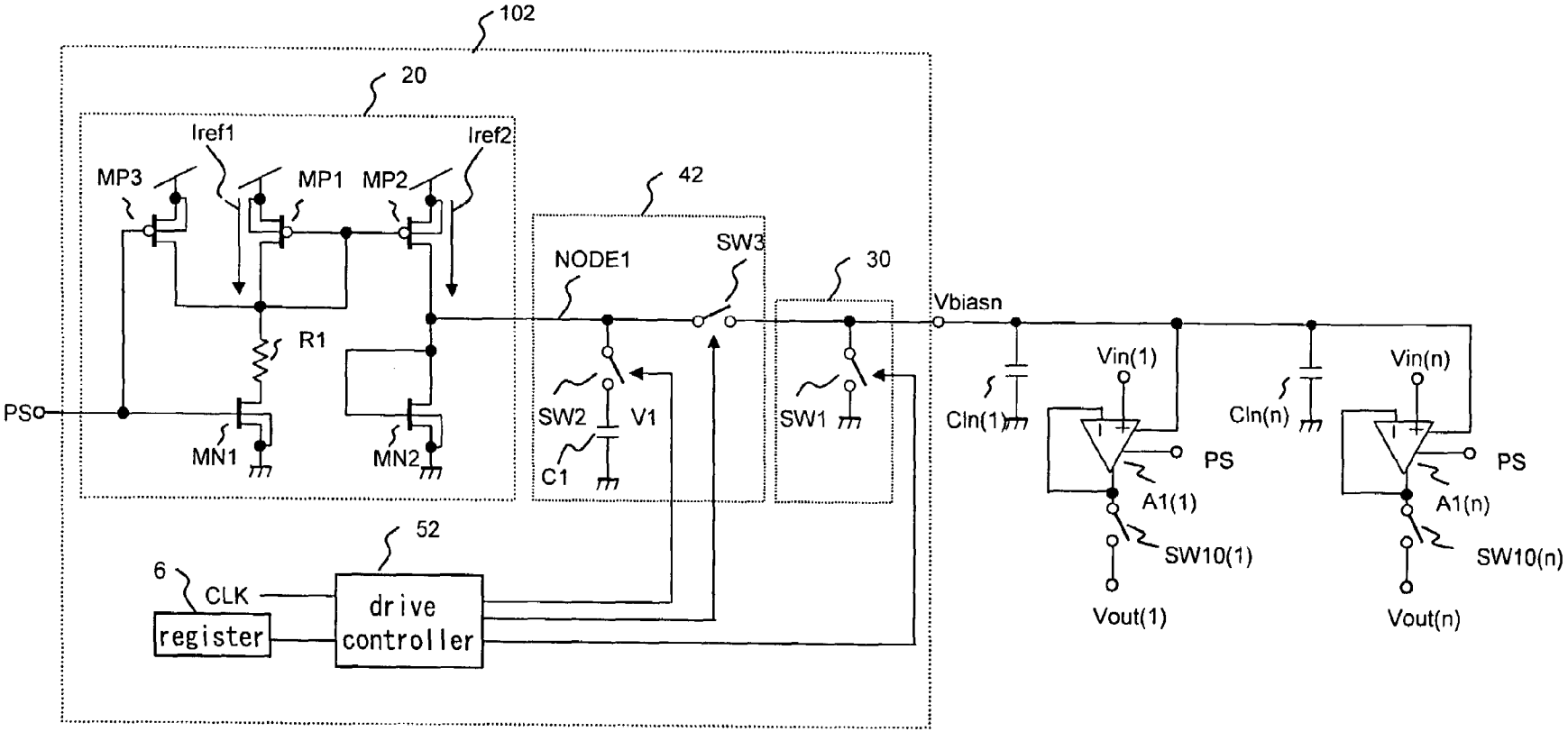
FIG. 5 is a circuit diagram of a bias voltage generating circuit according to a preferred embodiment 2 of the present invention.

FIG. 5 is a circuit diagram of a bias voltage generating circuit according to a preferred embodiment 2 of the present invention. The description below is given based on an example of the bias voltage generating circuit for driving liquid crystal in which a drive output number is n.

The preferred embodiment 2, wherein a constitution basically similar to that of the preferred embodiment 1 is provided, is characterized in that a reference voltage control switch SW3 controlled by a drive controller 52 is provided between an output Vbiasn of a bias voltage generating circuit 102 and an output NODE1 of the reference voltage generator 20.

In FIG. 5, a reference numeral 102 denotes a bias voltage generating circuit. The bias voltage generating circuit 102 comprises a reference voltage generator 20, a standby voltage generator 30, a voltage return unit 42, a drive controller 52, and a register 6. The reference voltage generator 20 comprises P-channel MOS transistors MP1, MP2 and MP3, N-channel MOS transistors MN1 and MN2 and a resistance R1. The standby voltage generator 30 comprises a switch SW1 connected to a ground voltage and a bias voltage Vbiasn. The voltage return unit 42 comprises a charge storing element C1, a switch SW2 and a reference voltage control switch SW3. The drive controller 52 controls the standby voltage generator 30, voltage return unit 42, and reference voltage control switch SW3. The register 6 controls the drive controller 52.

The bias voltage generating circuit 102 has a function of outputting the bias voltage Vbiasn of NMOS transistors for a constant current source in operational amplifiers A1(1)-A1(*n*) for driving the liquid crystal. In the drawing, C1*n*(1)-C1*n*(n) denotes a wiring capacitance respectively.

The drive controller 52 has first through third functions. The first function is a function of controlling a period when the standby voltage is outputted from the standby voltage generator 30 as the output Vbiasn of the bias voltage generating circuit 102 in accordance with a clock input signal CLK and a set value of the register 6 The second function is a function of controlling a period when the return voltage is outputted from the voltage return unit 42. The third function is a function of controlling a period when the reference voltage is separated by the reference voltage control switch SW3.

Figure 6:
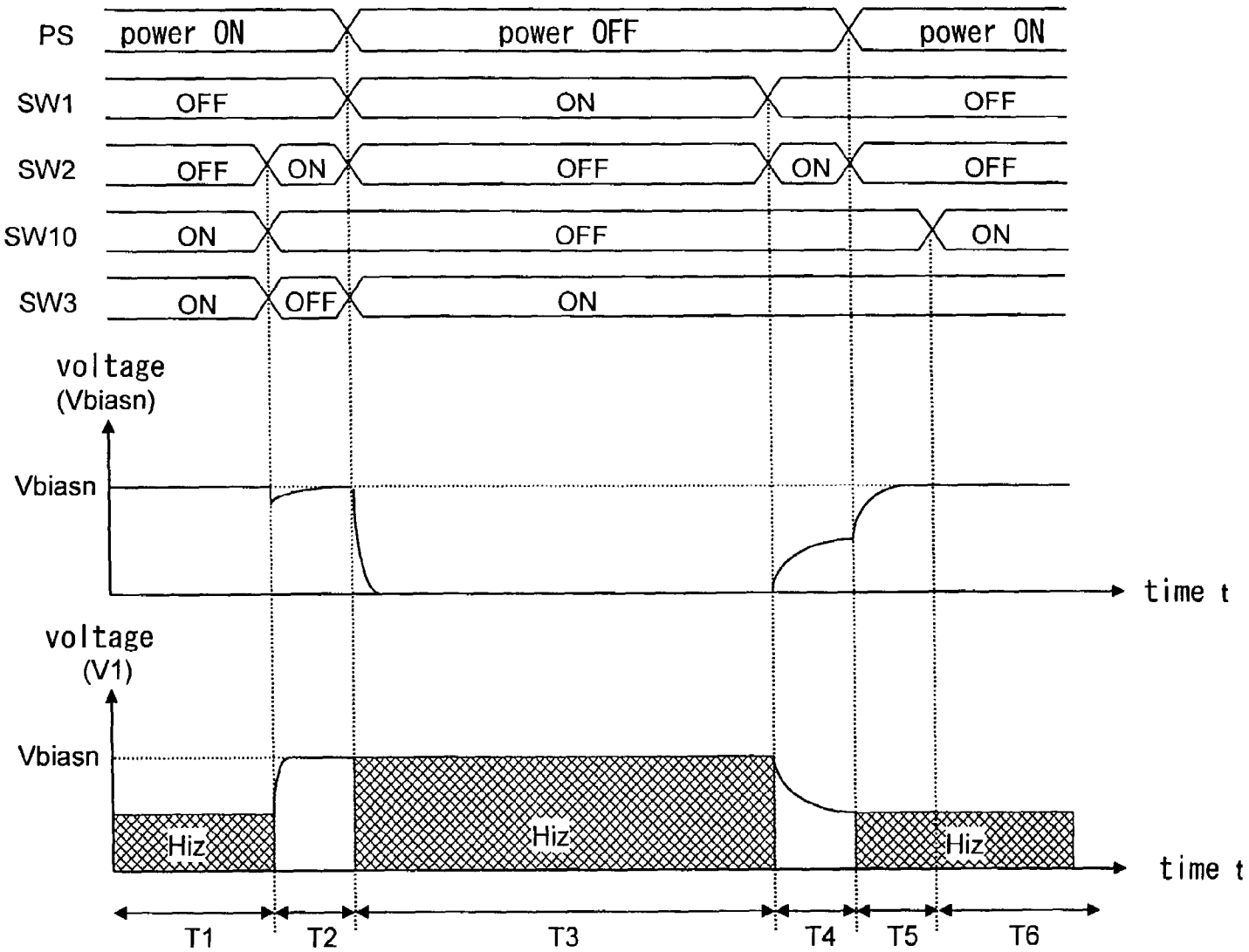
FIG. 6 is a timing chart of the bias voltage generating circuit according to the preferred embodiment 2.

Next, description is given to an return operation of the bias voltage generating circuit 102 thus constituted from the power OFF state referring to a timing chart shown in FIG. 6. In the T1 period where the main power is in ON state, the standby voltage output control switch SW1 and the return voltage output control switch SW2 are turned off, the reference voltage control switch SW3 is turned on, and output control switches SW10(1)-SW10(*n*) of outputs Vout(1)-Vout (n) of the operational amplifiers for driving the liquid crystal are turned on.

In the T1 period, the power save signal PS is in the non-active state "high". Therefore, the P-channel MOS transistor MP3 of the reference voltage generator 20 is turned off, and the N-channel MOS transistor MN1 thereof is turned on.

At the time, the P-channel MOS transistor MP1, resistance R1 and N-channel MOS transistor MN1 of the reference voltage generator 20 generate the reference current Iref1. A current mirror circuit comprising the P-channel MOS transistors MP1 and MP2 generates the reference current Iref2. The N-channel MOS transistor MN2 diode-connected to the P-channel MOS transistor MP2 generates the bias voltage Vbiasn based on the reference current Iref2. The bias voltage Vbiasn is supplied to input capacitances of the operational amplifiers A1(*a*)-A1(*n*) for driving the liquid crystal and the wiring capacitances C1*n*(1)-C1*n*(n).

In the T2 period where the first sub power is in ON state, the standby voltage output control switch SW1 is turned off, the return voltage output control switch SW2 is turned on, the reference voltage control switch SW3 is turned off, and the output control switches SW10(1)-SW10(*n*) of the outputs Vout(1)-Vout(n) of the operational amplifiers A1(1)-A1(*n*) for driving the liquid crystal are turned on.

In the T2 period, the return voltage output control switch SW2 is turned on, and the charge storing element C1 is thereby connected to the bias voltage Vbiasn. As a result, the charge storing element C1 of the voltage restorer 42 is charged.

Because the charge storing element C1 is connected to the bias voltage Vbiasn, the voltage of the bias voltage Vbiasn is fluctuated. However, the output voltage Vout of the operational amplifiers A1(1)-A1(*n*) for driving the liquid crystal is not affected by the fluctuation since the output control switches SW10(1)-SW10(*n*) of the outputs Vout(1)-Vout(n) of the operational amplifiers A1(1)-A1(*n*) for driving the liquid crystal are turned off.

In the T3 period where the main power is in OFF state, the standby voltage output control switch SW1 is turned on, the return voltage output control switch SW2 is turned off, the reference voltage control switch SW3 is turned off, and the output control switches SW10(1)-SW10(*n*) of the outputs Vout(1)-Vout(n) of the operational amplifiers for driving the liquid crystal are turned off.

In the T3 period (main power OFF state), the power save signal PS is set to the active state "low". Therefore, the P-channel MOS transistor MP3 and the N-channel MOS transistor MN3 of the reference voltage generator 20 are turned on, and the N-channel MOS transistor MN1 is turned off. As a result, the reference current Iref1 is "0" so as to result in the power OFF state.

The standby voltage output control switch SW1 is turned on, the return voltage output control switch SW2 is turned off, and the reference voltage control switch SW3 is turned off. As a result, the bias voltage Vbiasn is "low".

In the T4 period where the sub power is in OFF state, the power save signal PS is maintained in the active state "low". However, the standby voltage output control switch SW1 is turned off, the return voltage output control switch SW2 is turned on, the reference voltage control switch SW3 is turned on, and the output control switches SW10(1)-SW10(*n*) of the outputs Vout(1)-Vout(n) of the operational amplifiers A1(1)-A1(*n*) for driving the liquid crystal are turned off.

In the T4 period, the charges stored in the charge storing element C1 are discharged to the input capacitances of the operational amplifiers A1(l)-A1(*n*) for driving the liquid crystal and the wiring capacitances C1*n*(1)-C1*n*(n). As a result, the bias voltage Vbiasn is approximated to the predetermined voltage before the power ON starts.

In the T5 period where the second sub power is in ON state, the power save signal PS is set to the non-active state "high". The stand by voltage output control switch SW1 is turned off, the return voltage output control switch SW2 is turned off, the reference voltage control switch SW3 is turned on, and the output control switches SW10(1)-SW10(*n*) of the outputs Vout(1)-Vout(n) of the operational amplifiers for driving the liquid crystal are turned off.

In the T5 period, the voltage approximated to the predetermined voltage in the T4 period is regarded as the return start voltage of the bias voltage Vbiasn. Therefore, the bias voltage Vbiasn returns to the predetermined voltage with only the reference current Iref2 of the reference voltage generating circuit.

In the T6 period where the main power is in ON state, the power save signal PS is maintained in the non-active state "high". The respective control signals are the same control as in the T1 period. However, as the T6 period is a period immediately after the output control switches SW10(1)-SW10(*n*) of the outputs Vout(1)-Vout(n) of the operational amplifiers for driving the liquid crystal are switched from OFF to ON, it is necessary to complete a return of the bias voltage Vbiasn to the predetermined voltage.

As described above, in the bias voltage generating circuit 102 according to the preferred embodiment 2 thus constituted, after the bias voltage Vbiasn in the power OFF state is approximated once to the predetermined voltage at initiating power ON, the operation for returning start of the power ON state from that state can be initiated by providing the voltage restorer 42 capable of charging/discharging the return voltage and the drive controller 52. Such an operation was not possible in the conventional bias voltage generating circuit in which only the current from the reference voltage generator 20 was used for the return operation. As a result of the foregoing improvement, the bias voltage Vbiasn of the operational amplifiers for driving liquid crystal can return at a high speed in the bias voltage generating circuit 102 according to the preferred embodiment 2.

Further, the reference voltage control switch SW3 is provided in the voltage return unit 42 so that the charge storing element C1 of the voltage restorer 42 can be charged in the state where the input capacitances of the operational amplifiers A1(1)-A1(*n*) for driving the liquid crystal and the wiring capacitances C1*n*(1)-C1*n*(n) are separated. As a result, the power, that is consumed during the T2 period in order to charge the input capacitances of the operational amplifiers A1(1)-A1(*n*) for driving the liquid crystal and the wiring capacitances C1*n*(1)-C1*n*(n) in the preferred embodiment 1, can be reduced.

Because the reference voltage control switch SW3 is provided in the voltage return unit 42, it becomes unnecessary to simultaneously charge the input capacitances of the operational amplifiers A1(1)-A1(*n*) for driving the liquid crystal and the wiring capacitances C1*n*(1)-C1*n*(n). Accordingly, the capacitance value of the charge storing element C1 in the voltage return unit can be increased even if the period T2 where the charge storing element C1 is charged is set to have the same time length as in the preferred embodiment 1. As a result, the return start voltage can be further approximated to the predetermined voltage, which further speeds up the return time.

Further, the register 6 capable of controlling the ON and OFF periods of the standby voltage output control switch SW1 and the ON and OFF periods of the return voltage output control switch SW2 is provided so that the bias voltage Vbiasn at initiation of the power ON can be adjusted by only change of the register 6. As a result, the bias voltage Vbiasn can return at a high speed even in the case where the return time is delayed since the circuit characteristics are deteriorated due to the variations due to the temperature, power-supply voltage and the like.

Preferred Embodiment 3

Figure 7:
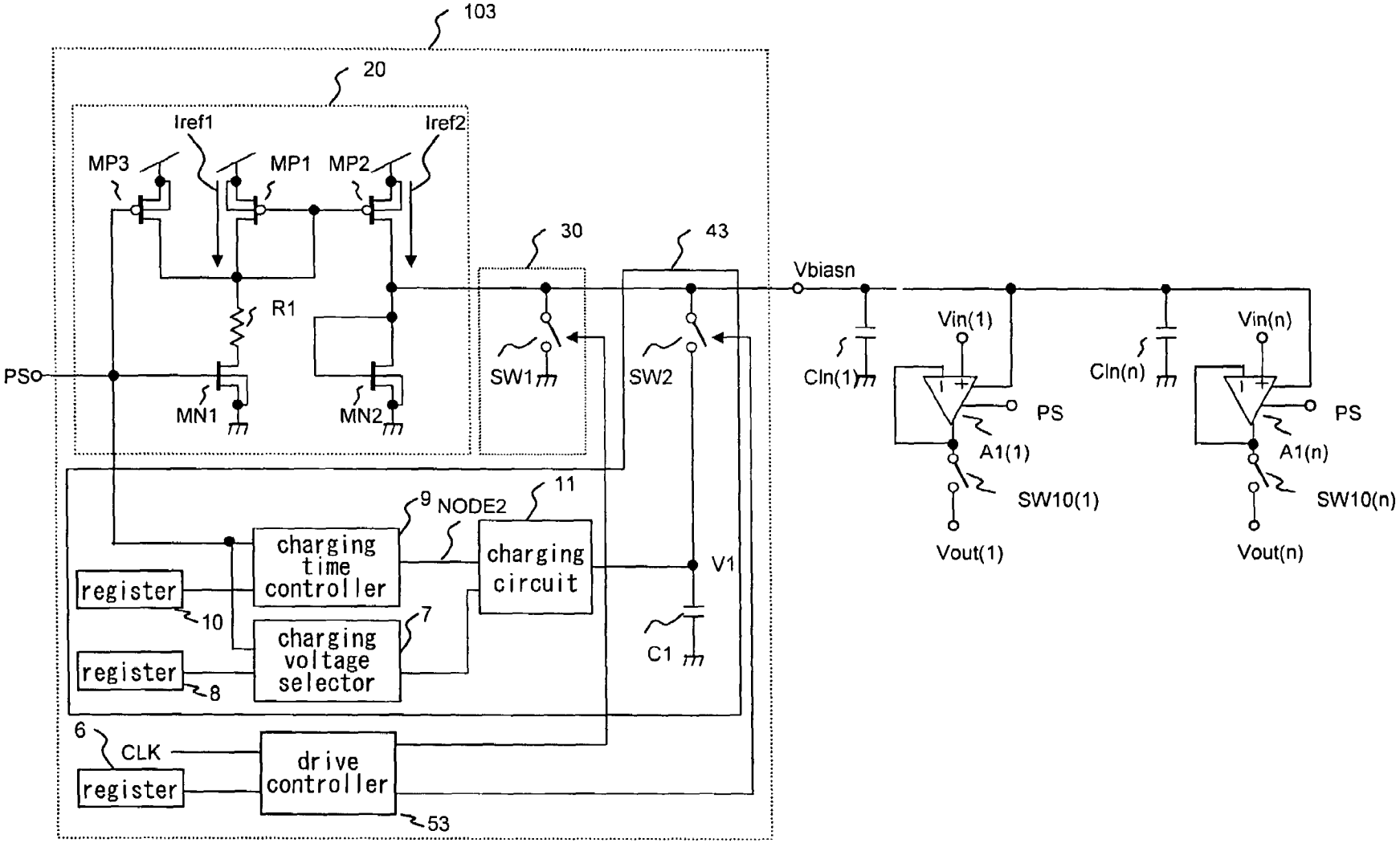
FIG. 7 is a circuit diagram of a bias voltage generating circuit according to a preferred embodiment 3 of the present invention.

FIG. 7 is a circuit diagram of a bias voltage generating circuit according to a preferred embodiment 3 of the present invention. The description below is given based on an example of the bias voltage generating circuit for driving liquid crystal in which a drive output number is n.

In FIG. 7, a reference numeral 103 denotes a bias voltage generating circuit. The bias voltage generating circuit 103 comprises a reference voltage generator 20, a standby voltage generator 30, a voltage return unit 43, a drive controller 53, and a register 6.

The reference voltage generator 20 comprises P-channel MOS transistors MP1, MP2 and MP3, N-channel MOS transistors MN1 and MN2, and a resistance R1. The standby voltage generator 30 comprises a switch SW1 connected to a ground voltage and a bias voltage Vbiasn. The voltage return unit 43 comprises a charge storing element C1, a switch SW2, a charging circuit 11 for charging the charge storing element C1, a charging time controller 9 for controlling a charging time of the charging circuit 11, a register 10 for controlling the charging time controller 9, a charging voltage selector 7 for selecting an output voltage V1 of the charging circuit 11, and a register 8 for controlling the charging voltage selector 7. The drive controller 53 controls the standby voltage generator 30 and the voltage return unit 43. The register 6 controls the drive controller 53.

The bias voltage generating circuit 103 has a function of outputting the bias voltage Vbiasn for NMOS transistors for a constant current source in operational amplifiers A1(1)-A1(*n*) for driving the liquid crystal. In the drawing, C1*n*(1)-C1*n*(n) denotes a wiring capacitance respectively.

The drive controller 53 has first and second functions. The first function is a function of controlling a period when the standby voltage is outputted from the standby voltage generator 30 as the output Vbiasn of the bias voltage generating circuit 103 in accordance with a clock signal CLK and a set value of the register 6. The second function is a function of controlling a period when the return voltage is outputted from the voltage return unit 43.

The charging time controller 9 is a circuit for generating a power save signal NODE2 for the charging circuit 11. The charging time controller 9 changes a set value of the register 10 so as to be able to change ON and OFF periods of the power save signal NODE2 for the charging circuit 11.

The charging voltage selector 7 is a circuit for selecting the output voltage V1 of the charging circuit 11, and can adjust the output voltage V1 by changing a set value of the register 8.

The charging circuit 11 is a circuit for charging the charge storing element C1, and determines the charging period and the output voltage V1 based on the setting of the register 10 by the charging time controller 9 and the setting of the register 8 by the charging voltage selector 7.

The voltage return unit 43 according to the present preferred embodiment is adapted in a manner different to those of the preferred embodiments 1 and 2, wherein the charge storing element C1 is not charged by the reference voltage generator 20 but charged by the charging circuit 11. Therefore, the return voltage can be charged in a period where the power save signal PS is non-active.

Figure 8:
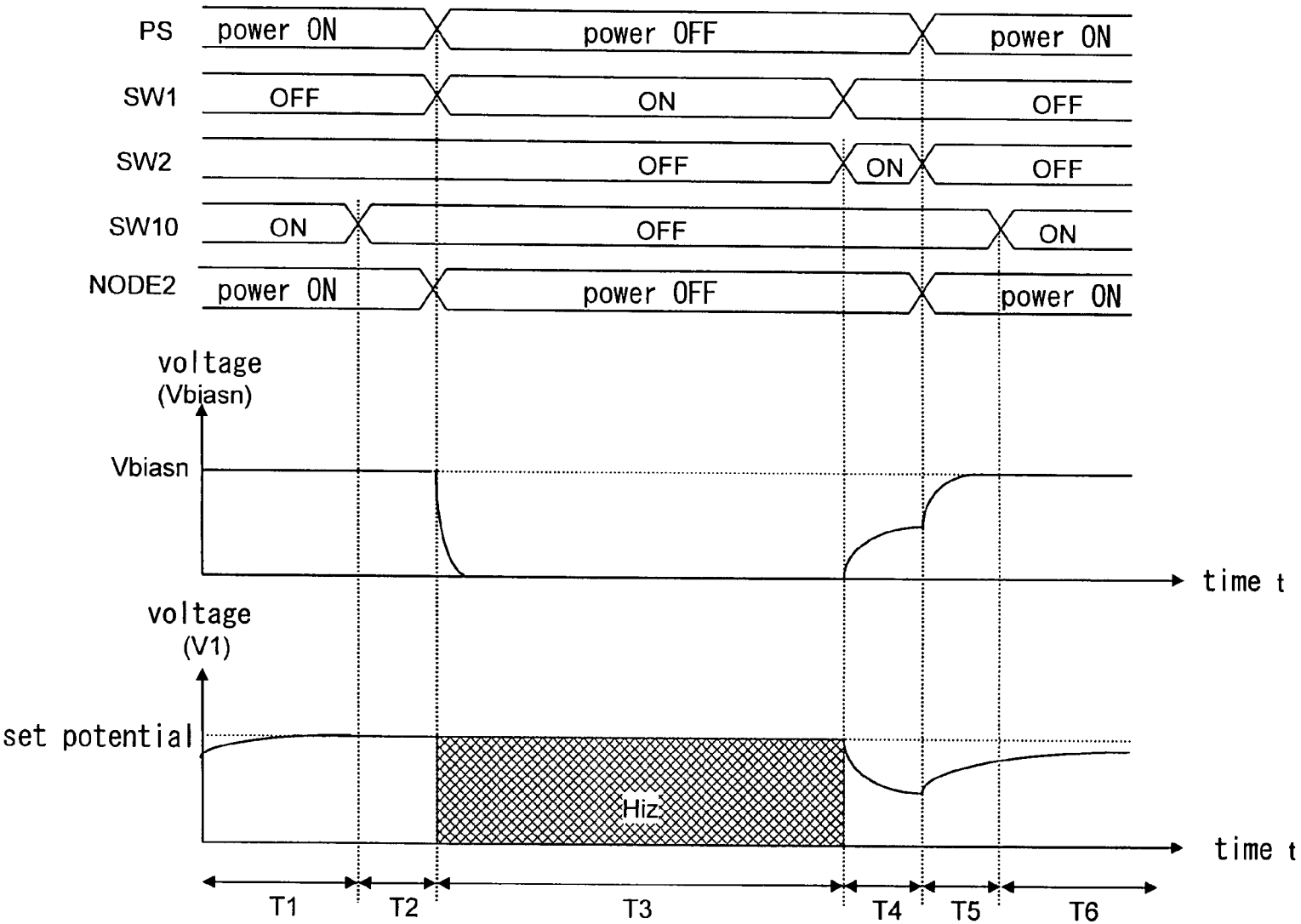
FIG. 8 is a timing chart of the bias voltage generating circuit according to the preferred embodiment 3.

Next, an return operation of the bias voltage generating circuit 103 thus constituted from the power OFF state is described referring to a timing chart shown in FIG. 8. In the T1 period where the main power is in ON state, the standby voltage output control switch SW1 and the return voltage output control switch SW2 are turned off, and output control switches SW10(1)-SW10(*n*) of outputs Vout(1)-Vout(n) of the operational amplifiers for driving the liquid crystal are turned on.

In the T1 period, the power save signal PS is set to the non-active state "high". Therefore, the P-channel MOS transistor MP3 of the reference voltage generator 20 is turned off, while the N-channel MOS transistor MN1 of the reference voltage generator 20 is turned on.

At the time, as the power save signal NODE2 for the charging circuit 11 is also set to the non-active state "high", the charging circuit 11 charges the charge storing element C1. However, the period where the power save signal NODE2 for the charging circuit 11 is maintained in the non-active state "high" can be arbitrarily changed in accordance with the set value of the register 10.

In the present preferred embodiment, it is assumed that the register 10 is set so that the power save signal PS and the power save signal NODE2 for the charging circuit 11 are controlled in the same manner. At the time, the P-channel MOS transistor MP1, resistance R1 and N-channel MOS transistor MN1 of the reference voltage generator 20 generate the reference current Iref1. A current mirror circuit comprising the P-channel MOS transistors MP1 and MP2 generates the reference current Iref2. The N-channel MOS transistor MN2 diode-connected to the P-channel MOS transistor MP2 generates the bias voltage Vbiasn based on the reference current Iref2. The bias voltage Vbiasn is supplied to the input capacitances of the operational amplifiers A1(1)-A1(*n*) for driving the liquid crystal and wiring capacitances C1*n*(1)-C1*n*(n).

In the T2 period where the first sub power is in ON state, the standby voltage output control switch SW1 and the return voltage output control switch SW2 are turned off, while the output control switches SW10(1)-SW10(*n*) of the outputs Vout(1)-Vout(n) of the operational amplifiers for driving the liquid crystal are turned on.

In the T2 period, as the power save signal NODE2 for the charging circuit 11 is maintained in the non-active state "high", the charging circuit 11 charges the charge storing element C1.

In the T3 period where the main power is in OFF state, the standby voltage output control switch SW1 is turned on, the return voltage output control switch SW2 is turned off, the reference voltage control switch SW3 is turned off, and the output control switches SW10(1)-SW10(*n*) of the outputs Vout(1)-Vout(n) of the operational amplifiers for driving the liquid crystal are turned off.

In the T3 period (main power OFF state), as the power save signal PS is in the active state "low", the P-channel MOS transistor MP3 and the N-channel MOS transistor MN3 of the reference voltage generator 20 are turned on and the N-channel MOS transistor MN1 is turned off. As a result, the reference current Iref1 is "0" so as to result in the power OFF state.

The power save signal NODE2 for the charging circuit 11 is in the active state "low" because the power save signal PS is in the active state "low" in the charging time controller 9 and the charging voltage selector 7. As a result, the T3 period results in the power OFF state.

In the T4 period where the sub power is in OFF state, the power save signal PS is maintained in the active state "low", however, the standby voltage output control switch SW1 is turned off, the return voltage output control switch SW2 is turned on, and the output control switches SW10(1)-SW10(*n*) of the outputs Vout(1)-Vout(n) of the operational amplifiers for driving the liquid crystal are turned off.

Because the power save signal PS is in the active state "low", the power save signal NODE2 for the charging circuit 11 is also in the active state "low". As a result, the power OFF state is maintained during the T4 period.

In the T4 period, the charges stored in the charge storing element C1 in the T2 period are discharged to the input capacitances of the operational amplifiers A1(1)-A1(*n*) for driving the liquid crystal and wiring capacitances C1*n*(1)-C1*n*(n). As a result, the voltage of the bias voltage Vbiasn is approximated to the predetermined voltage before the power ON starts.

In the T5 period where the second sub power is in ON state, the power save signal PS is set to the non-active state "high". The standby voltage output control switch SW1 is turned off, the return voltage output control switch SW2 is turned off, and the output control switches SW10(1)-SW10(*n*) of the outputs Vout(1)-Vout(n) of the operational amplifiers for driving the liquid crystal are turned on.

In the T5 period, the voltage approximated to the predetermined voltage in the T4 period is regarded as the return start voltage of the bias voltage Vbiasn. Therefore, it only requires the reference current Iref2 of the reference voltage generating circuit to return the bias voltage Vbiasn to the predetermined voltage.

In the T5 period, the return voltage output control switch SW2 is turned off, and the power save signal NODE2 for the charging circuit 11 is set to the non-active state-"high". Therefore, the charging circuit 11 starts to charge the charge storing element C1.

In the T6 period where the main power is in ON state, the power save signal PS is maintained in the non-active state "high". The respective control signals are the same as those in the T1 period. However, as the T6 period is a period immediately after the output control switches SW10(1)-SW10(*n*) of the outputs Vout(1)-Vout(n) of the operational amplifiers for driving the liquid crystal are switched from OFF to ON, it is necessary to complete return of the bias voltage Vbiasn to the predetermined voltage.

As described above, in the bias voltage generating circuit 103 according to the preferred embodiment 3, the voltage return unit 43 capable of charging/discharging the return voltage and the drive controller 53 are provided. Therefore, after the bias voltage Vbiasn in the power OFF state is approximated once to the predetermined voltage at initiating power ON, the operation for returning the power ON state from that state can be initiated. Such an operation was not possible in the conventional bias voltage generating circuit in which only the current from the reference voltage generator 20 was used for the return operation. As a result of the foregoing improvement, the bias voltage Vbiasn of the operational amplifiers for driving liquid crystal can return at a high speed in the bias voltage generating circuit 103 according to the preferred embodiment 3.

Further, the charging circuit 11 is provided in the voltage return unit 43, which makes it unnecessary to use the reference voltage generator 20 for the charging operation. As a result, the charge storing element C1 of the voltage return unit 43 can be constantly charged during the power ON period, and the capacitance value of the charge storing element C1 can thereby design to have a large value.

Further, the non-active period of the power save signal NODE2 for the charging circuit 11 can be easily changed since the register 10 is provided, and the charging period for the charge storing element C1 can be thereby arbitrarily changed. Further, the return voltage can be adjusted within the range of the power supply since the register 8 is provided, and the return start voltage in the T5 period can be thereby approximated to a level substantially equal to the bias voltage Vbians. As a result, the return time can be further reduced.

Further, the registers 6, 8 and 10 capable of controlling the ON and OFF periods of the standby voltage output control switch SW1 and the ON and OFF periods of the return voltage output control switch SW2 are provided so that the bias voltage Vbiasn at start of the power ON can be adjusted by only change of the registers 6, 8 and 10. As a result, the bias voltage Vbiasn can return at a high speed even in the case where the return time is delayed since the circuit characteristics are deteriorated due to the variations generated in the temperature, power-supply voltage and the like.

Preferred Embodiment 4

Figure 9:
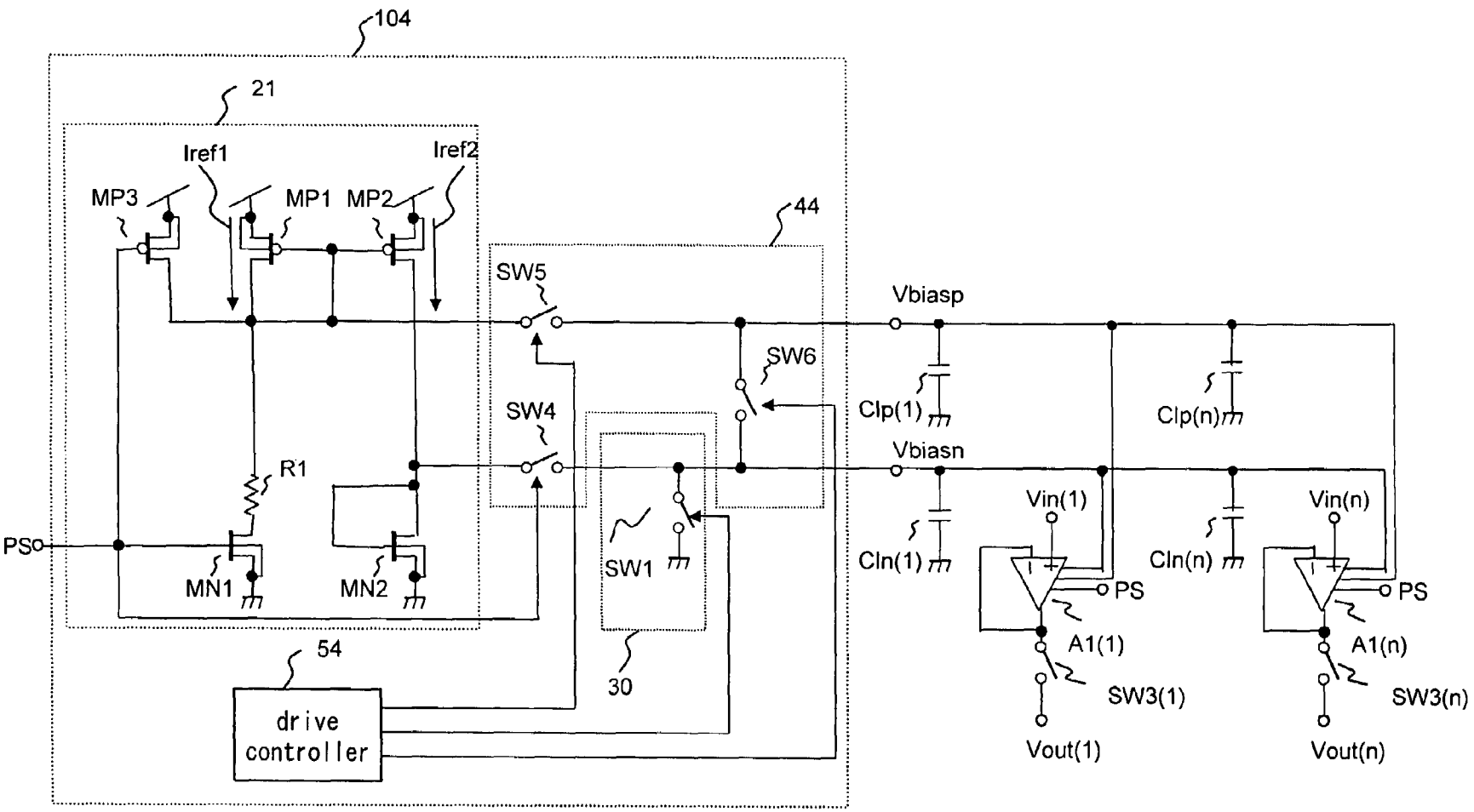
FIG. 9 is a circuit diagram of a bias voltage generating circuit according to a preferred embodiment 4 of the present invention.

FIG. 9 is a circuit diagram of a bias voltage generating circuit according to a preferred embodiment 4 of the present invention. The description below is given based on an example of the bias voltage generating circuit for driving liquid crystal in which a drive output number is n.

In FIG. 9, a reference numeral 104 denotes a bias voltage generating circuit. The bias voltage generating circuit 104 comprises a reference voltage generator 21, a standby voltage generator 30, a voltage return unit 44, and a drive controller 54.

The reference voltage generator 21 comprises P-channel MOS transistors MP1, MP2 and MP3, N-channel MOS transistors MN1 and MN2, and a resistance R1. The standby voltage generator 30 comprises a switch SW1 connected to a ground voltage and a bias voltage Vbiasn. The voltage return unit 44 comprises a switch SW6 connected to a bias voltage Vbiasp and the bias voltage Vbiasn, and reference voltage control switches SW4 and SW5. The drive controller 54 controls the reference voltage control switch SW5, standby voltage output control switch SW1 and voltage return control switch SW6.

The bias voltage generating circuit 104 has a function of outputting the bias voltage Vbiasn for NMOS transistors for a constant current source in operational amplifiers A1(1)-A1(*n*) for driving the liquid crystal and the bias voltage Vbiasp for PMOS transistors for a constant current source. In the drawing, C1*n*(1)-C1*n*(n) denotes a wiring capacitance respectively.

Figure 10:
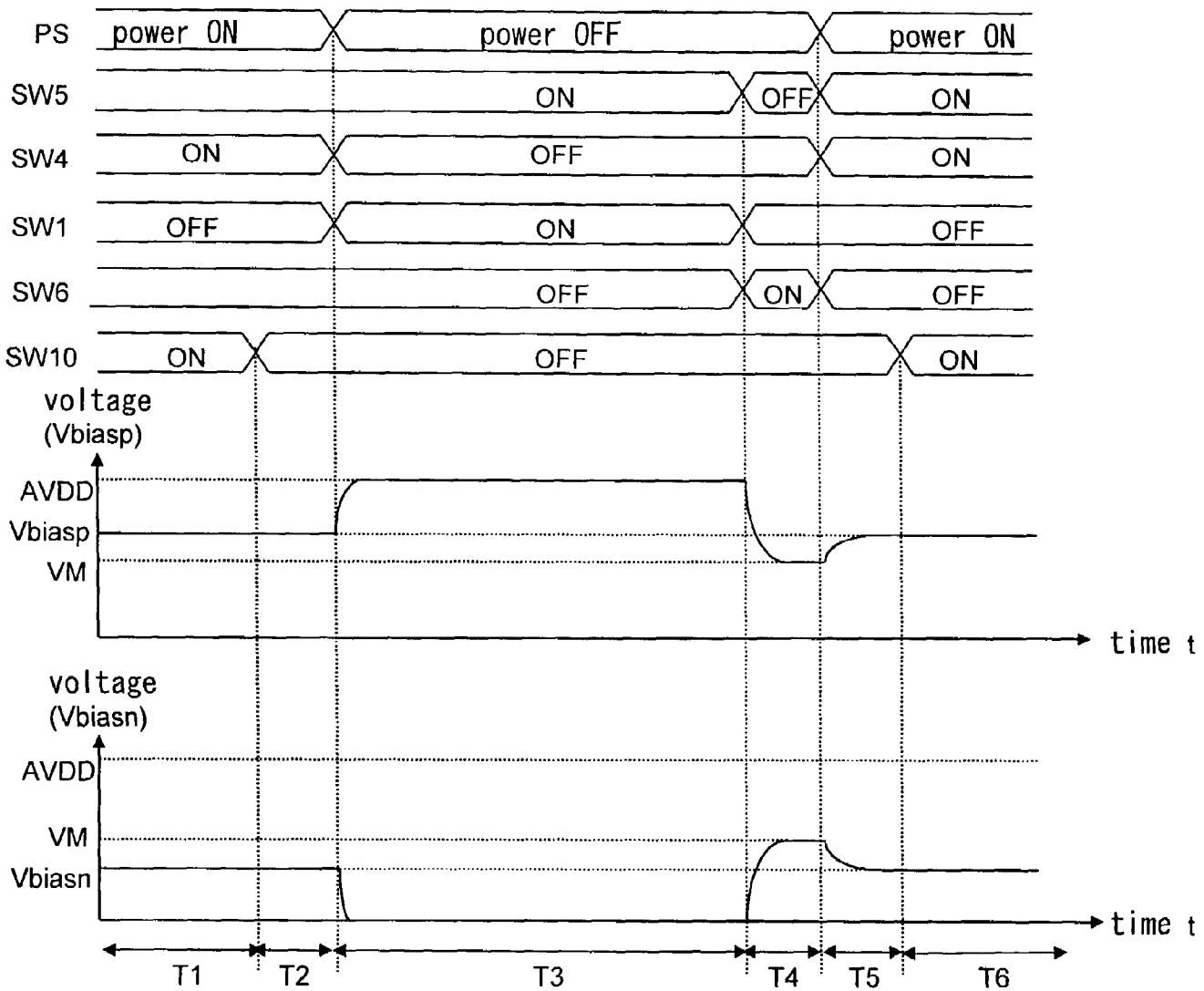
FIG. 10 is a timing chart of the bias voltage generating circuit according to the preferred embodiment 4.

Next, an operation of returning the bias voltage generating circuit 104 thus constituted from the power OFF state is described referring to a timing chart shown in FIG. 10. In the T1 period where the main power is in ON state, the standby voltage output control switch SW1 and the return voltage output control switch SW6 are turned off, the reference voltage control switches SW4 and SW5 are turned on, and the output control switches SW10(1)-SW10(*n*) of the outputs Vout(1)-Vout(n) of the operational amplifiers for driving the liquid crystal are turned on.

In the T1 period, the power save signal PS is set to the non-active state "high". Therefore, the P-channel MOS transistor MP3 of the reference voltage generator 21 is turned off, while the N-channel MOS transistor MN1 of the reference voltage generator 21 is turned on.

At the time, the P-channel MOS transistor MP1, resistance R1 and N-channel MOS transistor MN1 of the reference voltage generator 21 generate the reference current Iref1 and the bias voltage Vbiasp. A current mirror circuit comprising the P-channel MOS transistors MP1 and MP2 generates the reference current Iref2. The N-channel MOS transistor MN2 diode-connected to the P-channel MOS transistor MP2 generates the bias voltage Vbiasn based on the reference current Iref2.

At the time, the reference voltage control switches SW4 and SW5 are ON, and predetermined voltages are outputted as the bias voltages Vbiasp and Vbiasn. The bias voltage Vbiasn is supplied to the input capacitances of the operational amplifiers A1(1)-A1(*n*) for driving the liquid crystal and the wiring capacitances C1*n*(1)-C1*n*(n). The bias voltage Vbiasp is supplied to the input capacitances of the operational amplifiers A1(1)-A1(*n*) and wiring capacitances C1*p*(1)-C1*p*(n).

In the T2 period where the first sub power is in ON state, the power save signal PS is maintained in the non-active state "high". The standby voltage output control switch SW1 and the return voltage output control switch SW6 are turned off, the reference voltage control switches SW4 and SW5 are turned on, and the output control switches SW10(1)-SW10(*n*) of the outputs Vout(1)-Vout(n) of the operational amplifiers A1(1)-A1(*n*) for driving the liquid crystal are turned off. In the case where the power save signal is set to the active state "low" simultaneously when the output control switches SW10(1)-SW10(*n*) are turned off, the output voltages of the operational amplifiers for driving the liquid crystal are thereby affected. Therefore, the T2 period (first sub power ON state) is provided as an overlapping period (non-active state "high").

In the T3 period where the main power is in OFF state, the power save signal PS is set to the active state "low". Therefore, the P-channel MOS transistor MP3 and the N-channel MOS transistor MN3 of the reference voltage generator 21 are turned on, and the N-channel MOS transistor MN1 is turned off. As a result, the reference current Iref1 is "0" so as to result in the power OFF state.

At the time, as the reference voltage control switch SW5 is ON, the bias voltage Vbiasp is "high". Additionally, the reference voltage control switch SW4 is turned off, and the standby voltage output control switch SW1 is turned on. As a result, the bias voltage Vbiasn is "low".

In the T4 period where the sub power is in OFF state, the reference voltage control switches SW4, SW5 and the standby voltage output control switch SW1 are turned off, and the output control switches SW10(1)-SW10(*n*) are turned off. Then, the voltage return switch SW6 is turned on, and the bias voltage Vbiasp and the bias voltage Vbiasn result in an intermediate voltage VM existing between the predetermined voltage and the standby voltage of these bias voltages. As a result, the bias voltage Vbiasp and the bias voltage Vbiasn can be further approximated to the predetermined voltage of these bias voltages at a time point prior to the power-ON starting point (T5 period).

Preferred Embodiment 5

Figure 11:
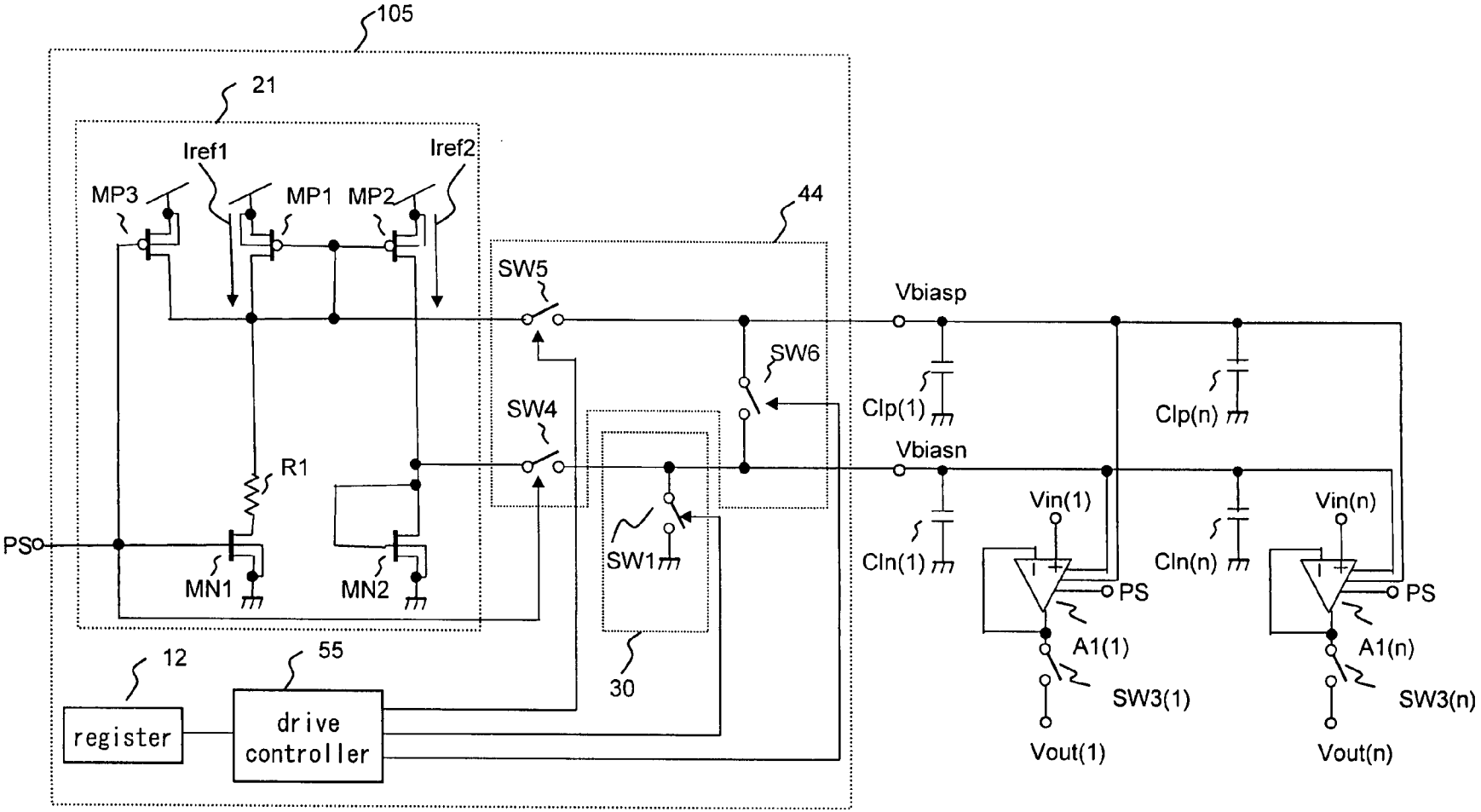
FIG. 11 is a circuit diagram of a bias voltage generating circuit according to a preferred embodiment 5 of the present invention.

FIG. 11 is a circuit diagram of a bias voltage generating circuit according to a preferred embodiment 5 of the present invention. The description below is given based on an example of the bias voltage generating circuit for driving liquid crystal in which a drive output number is n.

A bias voltage generating circuit 105 according to the preferred embodiment 5 is characterized in that a register 12 constituting a drive controller 55 for controlling ON and OFF periods of switchers is added to the drive controller 55 in the constitution according to the preferred embodiment 4 (bias voltage generating circuit 104).

In FIG. 11, a reference numeral 105 denotes a bias voltage generating circuit. The bias voltage generating circuit 105 comprises a reference voltage generator 21, a standby voltage generator 30, a voltage return unit 44, a drive controller 55 and a register 12.

The reference voltage generator 21 comprises P-channel MOS transistors MP1, MP2 and MP3, N-channel MOS transistors MN1 and MN2, and a resistance R1. The standby voltage generator 30 comprises a switch SW1 connected to a ground voltage and a bias voltage Vbiasn. The voltage return unit 44 comprises a switch SW6 connected to the bias voltage Vbiasp and the bias voltage Vbiasn, and reference voltage control switches SW4 and SW5. The drive controller 55 controls the reference voltage control switch SW5, standby voltage control switch SW1 and voltage return control switch SW6. The register 12 controls the drive controller 55.

The bias voltage generating circuit 105 has a function of outputting the bias voltage Vbiasn of NMOS transistors for a constant current source in operational amplifiers A1(1)-A1(*n*) for driving the liquid crystal and the bias voltage Vbiasp of PMOS transistors for a constant current source. In the drawing, C1*n*(1)-C1*n*(n) denotes a wiring capacitance respectively.

Figure 12:
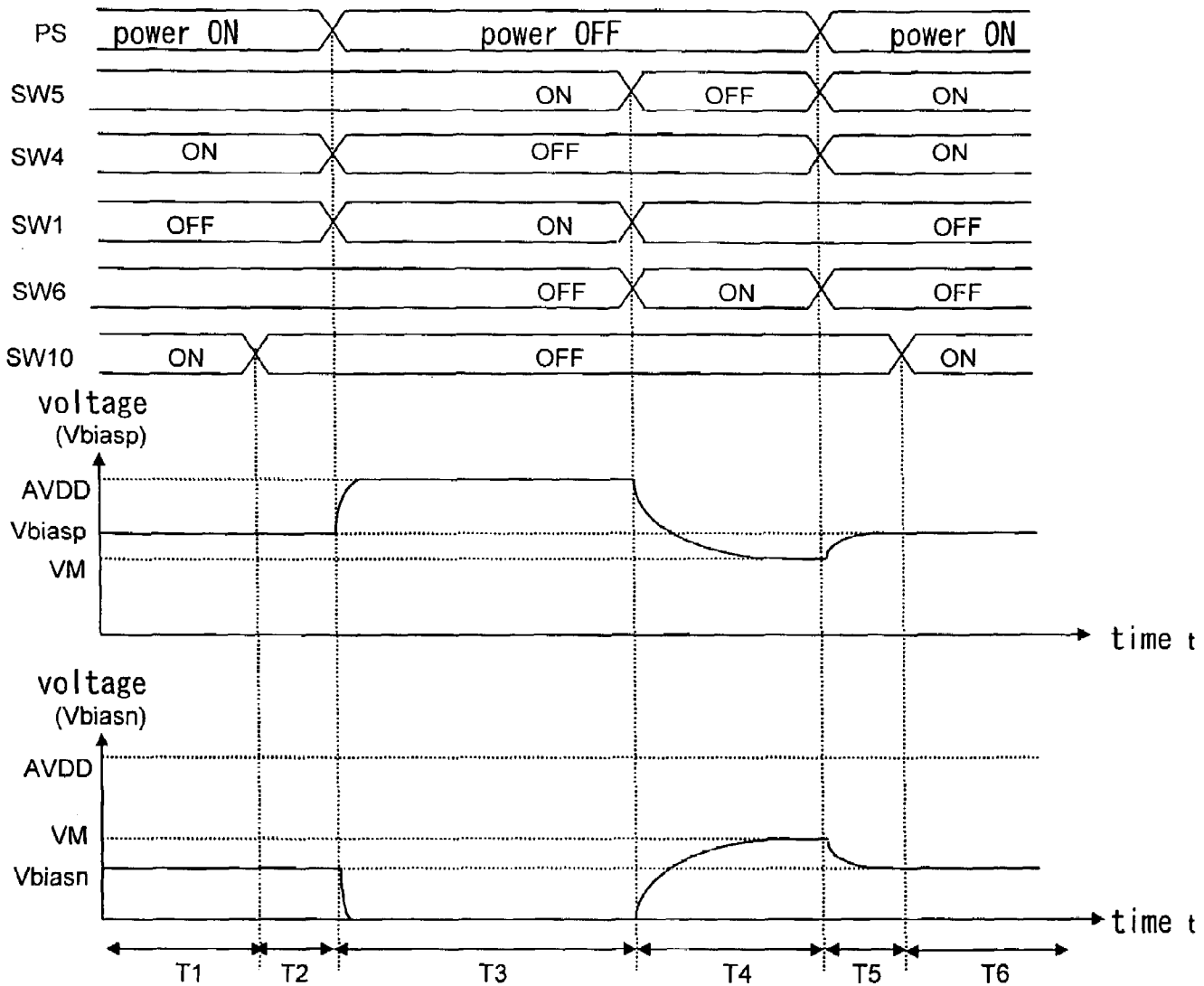
FIG. 12 is a timing chart of the bias voltage generating circuit according to the preferred embodiment 5.

Next, an operation of returning the bias voltage generating circuit 105 thus constituted from the power OFF state is described referring to a timing chart shown in FIG. 12. In the T1 period where the main power is in ON state, the standby voltage output control switch SW1 and the return voltage output control switch SW6 are turned off, the reference voltage control switches SW4 and SW5 are turned on, and the output control switches SW10(1)-SW10(*n*) of the outputs Vout(1)-Vout(n) of the operational amplifiers for driving the liquid crystal are turned on.

In the T1 period, the power save signal PS is set to the non-active state "high". Therefore, the P-channel MOS transistor MP3 of the reference voltage generator 21 is turned off, while the N-channel MOS transistor MN1 of the reference voltage generator 21 is turned on.

At the time, the P-channel MOS transistor MP1, resistance R1 and N-channel MOS transistor MN1 of the reference voltage generator 21 generate the reference current Iref1 and the bias voltage Vbiasp. A current mirror circuit comprising the P-channel MOS transistors MP1 and MP2 generates the reference current Iref2. The N-channel MOS transistor MN2 diode-connected to the P-channel MOS transistor MP2 generates the bias voltage Vbiasn based on the reference current Iref2. As the reference voltage control switches SW4 and SW5 are ON at the time, the predetermined voltages are outputted as the bias voltages Vbiasn and Vbiasp.

The bias voltage Vbiasn is supplied to the input capacitances of the operational amplifiers A1(1)-A1(*n*) and the wiring capacitances C1*n*(1)-C1*n*(n). The bias voltage Vbiasp is supplied to the input capacitances of the operational amplifiers A1(1)-A1(*n*) and wiring capacitances C1*p*(1)-C1*p*(n).

In the T2 period where the first sub power is in ON state, the power save signal PS is maintained in the non-active state "high". The standby voltage output control switch SW1 and the return voltage output control switch SW6 are turned off, the reference voltage control switches SW4 and SW5 are turned on, and the output control switches SW10(1)-SW10(*n*) of the outputs Vout(1)-Vout(n) of the operational amplifiers for driving the liquid crystal are turned off. In the case where the power save signal is set to the active state "low" simultaneously when the output control switches SW10(1)-SW10(*n*) are turned off, the output voltages of the operational amplifiers A1(1)-A1(*n*) for driving the liquid crystal are thereby affected. Therefore, the T2 period (first sub power ON state) is provided as an overlapping period (non-active state "high").

In the T3 period where the main power is in OFF state, the power save signal PS is set to the active state "low". Therefore, the P-channel MOS transistor MP3 and the N-channel MOS transistor MN3 of the reference voltage generator 21 are turned on, and the N-channel MOS transistor MN1 of the reference voltage generator 21 is turned off. As a result, the reference current Iref1 is "0" so as to result in the power OFF state.

At the time, as the reference voltage control switch SW5 is ON, the bias voltage Vbiasp is "high". The reference voltage control switch SW4 is turned off and the standby voltage output control switch SW1 is turned on. As a result, the bias voltage Vbiasn is "low".

In the T4 period where the sub power is in OFF state, the reference voltage control switches SW4 and SW5 and the standby voltage output control switch SW1 are turned off, and the output control switches SW10(1)-SW10(*n*) are turned off. Then, the bias voltage Vbiasp and the bias voltage Vbiasn result in an intermediate voltage VM existing between the predetermined voltage and the standby voltage of these bias voltages by turning on the voltage return switch SW6 in this state. As a result, the bias voltage Vbiasp and the bias voltage Vbiasn can be approximated to the predetermined voltage in these bias voltages at a time point prior to the power-ON starting point (T5 period).

The ON and OFF periods of the reference voltage control switch SW5, standby voltage control switch SW1 and voltage return control switch SW6 can be changed depending on the setting of the register 12. In other words, the bias voltage can be approximated to the predetermined voltage before the power ON starts even in the case where the capacitance value of the charge storing element C1 is large.

In the T5 period where the second sub power is in ON state, the power save signal PS is set to the non-active state "high". The standby voltage output control switch SW1 is turned off, the return voltage output control switch SW6 is turned off, the reference voltage control switches SW4 and SW5 are turned on, and the output control switches SW10(1)-SW10(*n*) of the outputs Vout(1)-Vout(n) of the operational amplifiers for driving the liquid crystal are also turned off.

In the T5 period, the voltage approximated to the predetermined voltage in the T4 period (intermediate voltage VM) is regarded as the return start voltage of the bias voltages Vbiasn and Vbiasp. Therefore, the bias voltages Vbiasn and Vbiasp can return to the predetermined voltage with only the reference currents Iref1 and Iref2 of the reference voltage generating circuit 104.

In the T6 period where the main power is in ON state, the power save signal PS is set to the non-active state "high". The respective control signals are the same control as in the T1 period. However, the T6 period is a period immediately after the output control switches SW10(1)-SW10(*n*) of the outputs Vout(1)-Vout(n) of the operational amplifiers for driving the liquid crystal are switched from OFF to ON and it is necessary to complete return of the bias voltages Vbiasn and Vbiasp to the predetermined voltage.

As described above, in the bias voltage generating circuit 105 according to the preferred embodiment 5, the voltage return unit 44 which short-circuits the bias voltages Vbiasn and Vbiasp and the drive controller 55 are provided so that the bias voltages Vbiasn and Vbiasp in the power OFF state are approximated once to the predetermined voltage, and then, the operation of returning these bias voltages to the power ON state from that state can start. Such an operation was not possible in the conventional bias voltage generating circuit 105 in which only the current from the reference voltage generator 21 was used for the return operation. As a result of the foregoing improvement, the bias voltages Vbiasn and Vbiasp of the operational amplifiers for driving liquid crystal can return at a high speed in the bias voltage generating circuit 105 according to the preferred embodiment 5.

Further, the period when the voltage return control switch SW6 of the voltage restorer 44 is turned on, that is the period when the bias voltages Vbiasn and Vbiasp are short-circuited, can be arbitrarily changed because the register 12 is provided. Therefore,in the case where the charge storing element C1 is desired to have a large capacitance value, the return operation can start after the bias voltages Vbiasn and Vbiasp at initiation of the power ON are approximated to the predetermined voltage by only changing a setup of the register 12.

Though the preferred embodiments of this invention has been described, it will be understood that various modifications may be made therein with respect to a combination and an arrangement of the parts, and it is intended to cover in the appended claims all such modifications as fall within the true spirit and scope of this invention.

What is claimed is:

1. A bias voltage generating circuit for generating a predetermined reference voltage suitable for a power ON state and a standby voltage suitable for a power OFF state as a bias voltage in response to the power ON/OFF switchover comprising:

a reference voltage generator for generating the reference voltage;

a standby voltage generator for generating the standby voltage;

a bias wiring for outputting the bias voltage;

a voltage return unit comprising a charge storing element and a first switch for connecting or disconnecting the charge storing element to the bias wiring; and a drive controller for controlling the standby voltage generator and the voltage return unit, wherein the drive controller switches over the first switch from an OFF state to ON state before the power ON state is switched to the power OFF state to thereby charge the bias voltage in the charge storing element, and switches over the first switch from an OFF state to ON state before the power OFF state is switched to the power ON state to thereby discharge the bias voltage charged in the charge storing element to an output load capacitance of the bias voltage generating circuit, and thereafter, the drive controller further approximates the bias voltage to the predetermined voltage and then starts an operation of shifting the bias voltage to the predetermined voltage before the power ON starts.

2. The bias voltage generating circuit as claimed in claim 1, further comprising a register, wherein the drive controller outputs control signal for controlling a charge/discharge period by the voltage return unit and an output period of the standby voltage by the standby voltage generator, and the register arbitrarily fluctuates the control signal to thereby arbitrarily change the charge/discharge period by the voltage return unit and the output period of the standby voltage by the standby voltage generator.

3. The bias voltage generating circuit as claimed in claim 1, wherein the voltage return unit further comprises a second switch for controlling permission or non-permission of the load capacitance output by the bias voltage generating circuit, the drive controller further controls the second switch, and the drive controller switches over the first switch from the OFF state to the ON state and simultaneously switches over the second switch from the ON state to the OFF state before the power ON state is switched to the power OFF state.

4. The bias voltage generating circuit as claimed in claim 3, further comprising a register, wherein the drive controller outputs control signal for controlling a charge/discharge period by the voltage return unit, a short-circuit period by the second switch, and an output period of the standby voltage by the standby voltage generator, and the register fluctuates the control signal to thereby arbitrarily change the charge/discharge period by the voltage return unit, the short-circuit period by the second switch, and the output period of the standby voltage by the standby voltage generator.

5. The bias voltage generating circuit as claimed in claim 1, wherein the voltage return unit comprises a charging circuit for charging the charge storing element and a charging time controller for controlling a power ON period of the charging circuit, and the drive controller controls the standby voltage generator and the voltage return unit.

6. The bias voltage generating circuit as claimed in claim 5, further comprising a first register, wherein the charging time controller outputs a control signal for controlling a charge/discharge period by the voltage return unit, and the first register fluctuates the control signal to thereby arbitrarily change the charge/discharge period by the voltage return unit.

7. The bias voltage generating circuit as claimed in claim 5, further comprising:

a charge voltage selector for fluctuating an output voltage of the charging circuit; and a second register for arbitrarily changing a charge amount stored in the charge storing element by controlling the charge voltage selector.

8. A bias voltage generating circuit for generating a predetermined reference voltage suitable for a power ON state and a standby voltage suitable for a power OFF state as a bias voltage in response to the power ON/OFF switchover comprising:

a reference voltage generator for generating a reference voltage;

a standby voltage generator for generating a standby voltage;

a voltage return unit comprising a first switch for short-circuiting the reference voltage and the standby voltage and a second switch for separating the reference voltage generator from an output of the bias voltage generating circuit; and a drive controller for controlling the standby voltage generator and the voltage return unit, wherein the drive controller switches over the second switch from the ON state to the OFF state before the power ON state is switched to the power OFF state to thereby separate the reference voltage generating circuit, and in such state, the drive controller further approximates the bias voltage to a predetermined voltage and then starts an operation of shifting the bias voltage to the predetermined voltage before the power ON starts by switching over the first switch from the OFF to the ON in order to thereby short-circuit the reference voltage and the standby voltage.

9. The bias voltage generating circuit as claimed in claim 8, further comprising a register, wherein the drive controller outputs control signal for controlling a short-circuit period of the first switch and an output period of the standby voltage, and the register arbitrarily fluctuates the control signal to thereby arbitrarily change the short-circuit period of the first switch and the output period of the standby voltage by the standby voltage generator.

* * * * *